United States Patent [19]

Yogo

[11] Patent Number: 4,703,739

[45] Date of Patent: Nov. 3, 1987

[54] ENGINE AUXILIARY STARTING DEVICE

[75] Inventor: Kenji Yogo, Atagonishi, Japan

[73] Assignee: Aisin Seiki Kabushiki Kaisha, Kariya, Japan

[21] Appl. No.: 845,470

[22] Filed: Mar. 28, 1986

[30] Foreign Application Priority Data

Mar. 28, 1985 [JP] Japan ..... 60-43905[U]

[51] Int. Cl.[4] ..... F02M 5/08

[52] U.S. Cl. ..... 123/520; 137/79; 251/129.15; 261/DIG. 67

[58] Field of Search ..... 123/520, 519, 518, 516; 251/129.15, 129.01; 137/79; 261/DIG. 67

[56] References Cited

U.S. PATENT DOCUMENTS

| | | | |
|---|---|---|---|
| 4,124,192 | 11/1978 | White | 251/129.15 |
| 4,425,767 | 1/1984 | Barbier | 251/129.15 |
| 4,495,904 | 1/1985 | Sakaino et al. | 123/520 |
| 4,577,607 | 3/1986 | Nishio | 123/519 |

*Primary Examiner*—Andrew M. Dolinar

*Attorney, Agent, or Firm*—Oblon, Fisher, Spivak, McClelland, & Maier

[57] ABSTRACT

An engine auxiliary starting device installed in an outer vent control system of an automotive internal combustion engine for leading fuel evaporative gases from a float chamber to a canister. The auxiliary device includes an electromagnetic valve having an integrated circuit board which includes a sensor mechanism for detecting a predetermined temperature and a timer circuit for supplying an electric current to a solenoid coil for a predetermined time.

5 Claims, 5 Drawing Figures

ENGINE AUXILIARY STARTING DEVICE

BACKGROUND OF THE INVENTION

1. Field of the Invention

This invention generally relates to engine auxiliary starting devices of the type mounted in an outer vent control system of an internal combustion engine, and more particularly to an engine auxiliary starting device which leads fuel evaporative gases, which are produced in a float chamber at a high temperature, to a canister, thereby preventing the fuel evaporative gases from being discharged into the atmosphere after the engine starts.

2. Background of the Prior Art

Auxiliary devices of the type to which the present invention is directed are particularly well adapted for use in an outer vent control system of an automotive internal combustion engine. When the engine is stopped after reading a high temperature, the gasoline within the engine will evaporate due to the high temperature, such that the fuel will become rich due to the fuel evaporative gases. Therefore, it will be difficult to start the engine again.

FIG. 1 shows a conventional engine auxiliary starting device installed in the outer vent control system, wherein fuel evaporative gases discharged from a carburetor 1 flow into a float chamber 2 and reach a canister 5, through a thermal responsive valve 3 and an electromagnetic valve 4, in which fuel evaporative gases are condensed and sent to a fuel tank.

The electromagnetic valve 4 is kept closed during engine starting and is opened once the engine stops. The thermal responsive valve 3 is kept closed at an ambient temperature below 50° C. and is opened at an ambient temperature greater than 50° C. Therefore, when the ambient temperature is more than 50° C. after the engine stops, fuel evaporative gases discharged from the float chamber 2 flow into the canister 5 through the thermal responsive valve 3 and the electromagnetic valve 4.

The predetermined temperature at which the thermal responsive valve 3 will operate is determined by actually surveying the relation between the ambient temperature of the thermal responsive valve 3 and the float chamber 2.

However, as shown in FIG. 2, there is a difference in the change of temperature between the thermal responsive valve and the float chamber after the engine stops. Furthermore, the positions of the float chamber 2 and the thermal responsive valve 3 are kept separate from one another, and there is a temperature hysteresis produced during operation of the thermal responsive valve 3 since a bimetallic disc is used as a thermal detective means.

Therefore, the time period of opening of the thermal responsive valve 3 is maintained longer than is necessary and also the fuel evaporative gases become too lean or weak because the canister 5 is connected with atmosphere during engine stopping. Therefore, the performance of engine starting after the engine has been stopped for a long period of time will deteriorate and the fuel consumption will increase.

SUMMARY OF THE INVENTION

A principal object of the present invention, therefore, is to provide a new and improved engine auxiliary starting device which is well adapted for use in an outer vent control system of an automotive internal combustion engine.

A further object of the present invention is to provide an engine auxiliary starting device wherein an electromagnetic valve and a thermal responsive valve are integrally connected and form a unitary valve body.

Another object of the present invention is to provide an engine auxiliary starting device having an IC (Integrated Circuit) board incorporated as a thermal responsive means and as a time responsive means.

BRIEF DESCRIPTION OF THE DRAWINGS

These and other objects as well as advantages of the present invention will become clear by the following description of a preferred embodiment of the present invention with reference to the accompanying drawings, wherein.

DESCRIPTION OF THE PREFERRED EMBODIMENTS

Figure 1:
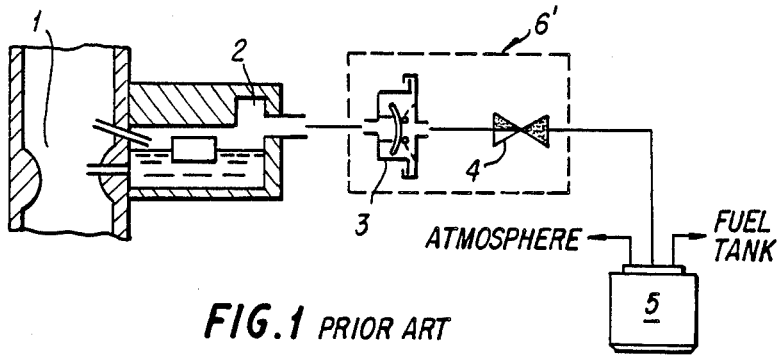
FIG. 1 PRIOR ART
FIG. 1 is a schematic illustration of an engine outer vent control system incorporating a conventional engine auxiliary starting device.
Figure 2:
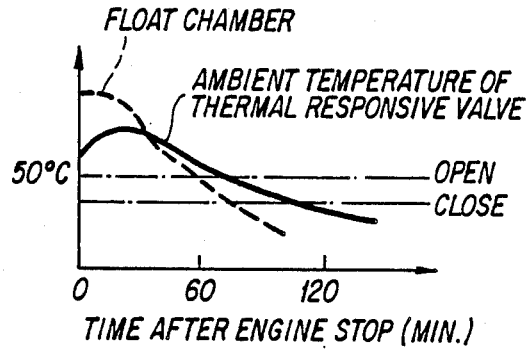
FIG. 2 PRIOR ART
FIG. 2 is a diagram explaining the change of temperature after engine stopping according to a conventional device.
Figure 3:
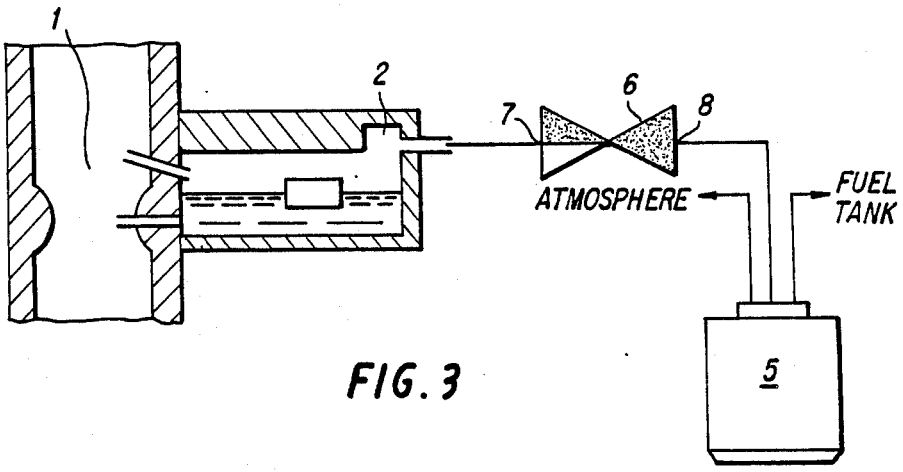
FIG. 3 is a schematic illustration of an engine outer vent control system incorporating an engine auxiliary starting device according to the present invention.
Figure 4:
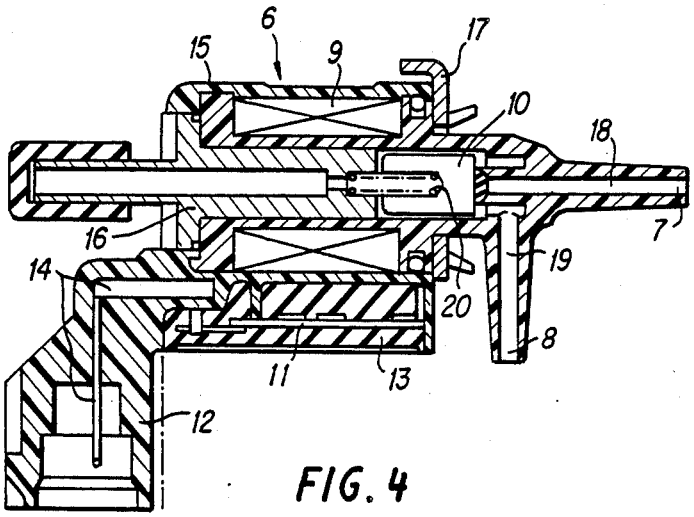
FIG. 4 is a sectional view of an embodiment of the engine auxiliary starting device shown in FIG. 3.
Figure 5:
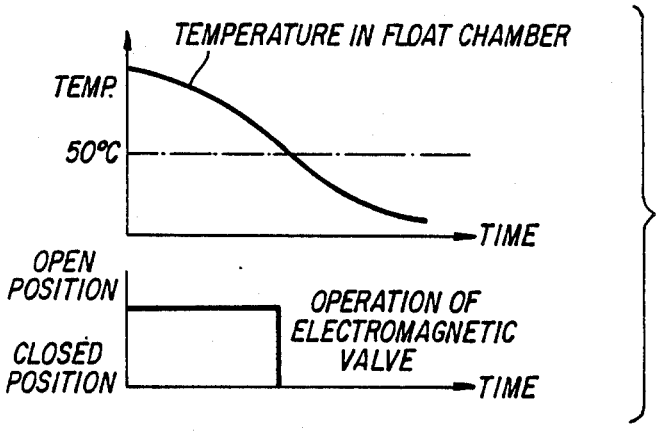
FIG. 5 is a diagram explaining the relation between ambient temperature and opening time of the electromagnetic valve according to the present invention.

Referring now to FIGS. 3 and 4 showing an embodiment of the present invention corresponding to that portion indicated by numeral 6' in FIG. 1, an electromagnetic valve 6 includes a nonmagnetic bobbin 15 made of a synthetic resin, an inlet port 7 connected with a float chamber 2 shown in FIG. 1 and an outlet port 8 connected with a canister 5 as also illustrated in FIG. 1.

The bobbin 15 is provided with fluid passages 18 and 19 through which the inlet port 7 and the outlet port 8 communicate with each other. A solenoid coil 9 is wound on the bobbin 15 to which a synthetic resin housing 12 is secured. An inner core 16 and a valve member 10 are arranged in a central bore formed in the bobbin 15. A magnetic yoke 17 made of iron is secured on the rightward end of the bobbin 15 in order to form a magnetic circuit which includes the inner core 16 and the solenoid coil 9.

The valve member 10 is biased rightwardly by a spring 20 mounted on the inner core 16 at one end thereof. When current is applied to the solenoid coil 9, the valve member 10 is attracted by the energization of the coil 9 against the spring 20 and then is kept open, whereby both ports 7 and 8 are connected with each other. When an IC (Integrated Circuit) board 11 is operated, the current is applied to the coil 9.

The IC board 11 includes a thermistor for detecting a predetermined temperature and a CMOS (Complementary Metal Oxide Semiconductor) integrated circuit for detecting a predetermined time, and is fixed in a lower portion of the housing 12 by means of plugging silicone gel 13.

A terminal 14 is electrically connected with the IC board 11 to supply current thereto. The IC board 11 is operated at an ambient temperature of more than 50° C. and applies the current to the solenoid coil 9 for a predetermined time, for example 60 minutes, thereby keeping the electromagnetic valve 6 open. The IC board 11 is not operated at an ambient temperature below 50° C., whereby the electromagnetic valve 6 is not kept open.

In operation, when the ambient temperature is more than 50° C. after engine stopping, IC board 11 is operated during a predetermined time, for example 60 minutes, in response to signals from the thermistor and CMOS Integrated Circuit and applies an electric current supplied from the terminal 14 to the solenoid coil 9 during operation of the IC board 11, whereby the valve member 10 is attracted to the inner core 16 and maintained in the open position, so that the fuel evaporative gases discharged from the float chamber 2 may flow into the canister 5 through the engine auxiliary starting device 6, with the result being that the fuel evaporative gases are condensed in the canister 5 and returned to the fuel tank.

It will be understood that modification and variations may be effected without departing from the scope of the novel concepts of the present invention.

What is claimed as new and desired to be secured by Letters Patent of the United States is:

1. An engine auxiliary starting device for leading fuel evaporative gases produced in a float chamber to a canister and for supplying said fuel evaporative gases condensed by said canister to a fuel tank, said engine auxiliary starting device comprising:

an electromagenetic valve which includes a bobbin made of a nonmagnetic material and having an inlet port and outlet port formed therein;

a solenoid coil wound on said bobbin;

an inner core positioned in a central bore formed in said bobbin;

a yoke member made of magnetic material and secured on said bobbin for forming a magnetic circuit with said inner core and said solenoid coil;

a valve member positioned so as to be attracted by said inner core upon energization of said solenoid coil;

a housing secured to said bobbin; and sensor means for detecting a predetermined temperature upon stopping of the engine and timer circuit means responsive to a detection of at least said predetermined temperature by said sensor means for supplying an electric current to said solenoid coil to open said valve member for a predetermined time, wherein said sensor means and timer circuit means comprise an integrated circuit board positioned in said housing.

2. An engine auxiliary starting device as defined in claim 1, wherein said sensor means includes a thermistor.

3. An engine auxiliary starting device as defined in claim 1, wherein said timer circuit includes a CMOS integrated circuit.

4. An engine auxiliary starting device as set forth in claim 1, wherein said valve member is positioned in said magnetic circuit.

5. An engine auxiliary starting device as defined in claim 1, wherein said valve member is disposed in said central bore of said bobbin.

* * * * *